US009091987B2

(12) United States Patent
Ohmiya et al.

(10) Patent No.: US 9,091,987 B2
(45) Date of Patent: Jul. 28, 2015

(54) IMAGE FORMING APPARATUS AND IMAGE FORMING APPARATUS CONTROL METHOD

(71) Applicants: Yutaka Ohmiya, Tokyo (JP); Tadashi Shinohara, Kanagawa (JP); Yasuhiro Abe, Kanagawa (JP); Hiroaki Nishina, Kanagawa (JP)

(72) Inventors: Yutaka Ohmiya, Tokyo (JP); Tadashi Shinohara, Kanagawa (JP); Yasuhiro Abe, Kanagawa (JP); Hiroaki Nishina, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/013,572

(22) Filed: Aug. 29, 2013

(65) Prior Publication Data

US 2014/0072315 A1 Mar. 13, 2014

(30) Foreign Application Priority Data

Sep. 12, 2012 (JP) ..... 2012-200977

(51) Int. Cl.
*G03G 15/00* (2006.01)
*G03G 15/01* (2006.01)

(52) U.S. Cl.
CPC ..... *G03G 15/5041* (2013.01); *G03G 15/0131* (2013.01); *G03G 15/5058* (2013.01); *G03G 2215/0161* (2013.01)

(58) Field of Classification Search
CPC ..... G03G 15/5041; G03G 15/0131; G03G 15/5058; G03G 2215/0161
USPC ..... 399/49, 72
See application file for complete search history.

(56) References Cited

U.S. PATENT DOCUMENTS

2006/0233561 A1* 10/2006 Yamaoka ..... 399/49
2011/0058832 A1* 3/2011 Suzuki et al. ..... 399/49
2012/0134702 A1* 5/2012 Fujiwara ..... 399/72

FOREIGN PATENT DOCUMENTS

JP 2006-293240 10/2006
JP 2012-022054 2/2012

* cited by examiner

*Primary Examiner* — Ryan Walsh
(74) *Attorney, Agent, or Firm* — Harness, Dickey & Pierce, P.L.C.

(57) ABSTRACT

An image forming apparatus includes a first image forming unit that forms toner images based on image data on first image carriers; a second image carrier, on which the toner images formed on the first image carriers are transferred; a second image forming unit that transfers the toner images transferred on the second image carrier onto a transfer medium; a test pattern generating unit that generates a test pattern group with a predetermine length in a moving direction of the second image carrier; and an adjusting unit that determines a method to adjust an image formation condition for the first image forming unit using the test pattern group, based on a relationship between the predetermined length and a length of an image area, in which a print image based on the image data is formed, in a sub-scanning direction corresponding to the moving direction of the second image carrier.

12 Claims, 11 Drawing Sheets

IMAGE FORMING APPARATUS AND IMAGE FORMING APPARATUS CONTROL METHOD

CROSS-REFERENCE TO RELATED APPLICATIONS

The present application claims priority to and incorporates by reference the entire contents of Japanese Patent Application No. 2012-200977 filed in Japan on Sep. 12, 2012.

BACKGROUND OF THE INVENTION

1. Field of the Invention

The present invention relates to an image forming apparatus that forms an image with toners of multiple colors and to an image forming apparatus control method.

2. Description of the Related Art

Conventionally, there is a known image forming apparatus that forms electrostatic latent images on photoreceptors through optical writing, temporarily transfers toner images developed from the electrostatic latent images onto an intermediate transfer member, such as an intermediate transfer belt, for each of colors such that the toner images of the respective colors are superimposed on the intermediate transfer member, transfers the toner images of the respective colors from the intermediate transfer member to a sheet of paper, and fixes the toner images to the sheet of paper to thereby form a color image.

In such an image forming apparatus, image adjustment, such as color misregistration correction or density correction, on an image to be formed is generally performed by forming a test pattern on the intermediate transfer belt and detecting the test pattern by a sensor. However, normal image formation on the sheet of paper cannot be performed while the above-described image adjustment is being performed. Therefore, if the image adjustment is frequently performed, downtime increases, during which the image formation on the sheet of paper is interrupted. Consequently, it becomes difficult to efficiently form images.

Japanese Patent Application Laid-open No. 2006-293240 discloses a technology in which, in an image forming apparatus where the maximum image width available for image formation in the main-scanning direction is smaller than a sum of the maximum width of an available recording material in the main-scanning direction and the lengths of pattern images formed at two portions for density correction or misregistration correction in the width direction of the recording material, an area where the pattern images are to be formed is changed depending on whether the width of a recording material to be actually used is equal to or smaller than a threshold or whether the width of the recording material is greater than the threshold. More specifically, if the width of a recording material to be used is equal to or smaller than the threshold, the pattern images are formed in an image area through which a sheet of paper does not pass, and, if the width of the recording material is greater than the threshold, the pattern images are formed in an inter-sheet area between the trailing end of a preceding recording material and the leading end of a following recording material. According to Japanese Patent Application Laid-open No. 2006-293240, it is possible to prevent an increase in the size of the image forming apparatus in the sheet width direction due to formation of the pattern images for density correction or misregistration correction in an area outside the maximum sheet width, and it is also possible to prevent a decrease in the throughput due to formation of the pattern images in the inter-sheet area.

Meanwhile, in the conventional image adjustment method in which a test pattern is formed in an area outside a printing area in parallel with printing of the image, an execution condition is set such that the size of a printing image in the main-scanning direction is smaller than a predetermined size in order to prevent overlapping of the printing image and the test pattern, but the size of the printing image in the sub-scanning direction is not set in the execution condition.

An example will be described below, in which images are sequentially formed on a page-by-page basis. In this case, an image formation condition for a next page following a current page is set after completion of the image formation of the current page is detected. When a test pattern is formed in parallel with the printing image, settings for the test pattern are set at the same time settings for the next page are set.

When the test pattern is formed in parallel with the printing image without taking into account the image size in the sub-scanning direction, a timing at which formation of the printing image is completed and a timing at which formation of the test pattern is completed cannot be distinguished. Therefore, in the conventional operation for setting image settings for a next page after detecting the completion of the image formation of a current page, the image settings may be set even before formation of the test pattern is not completed. In this case, there is a problem in that a formation condition for the test image may be changed while the test pattern is being formed.

In the technology disclosed in Japanese Patent Application Laid-open No. 2006-293240, because only a sheet size in the main-scanning direction is set as a determination condition, if the test pattern is formed without taking into account the image size in the sub-scanning direction, a timing of completion of the formation of the test pattern cannot be distinguished. Therefore, even with the technology of Japanese Patent Application Laid-open No. 2006-293240, it is difficult to set the image settings for a next page at an appropriate timing, so that it is difficult to solve the problem in that the formation condition for the test image may be changed while the test pattern is being formed.

Therefore, there is a need for an image forming apparatus capable of executing image settings at an appropriate timing when a test pattern is formed in an area outside a printing area in parallel with printing of the image.

SUMMARY OF THE INVENTION

According to an embodiment, there is provided an image forming apparatus that includes a first image forming unit that forms toner images based on image data on a plurality of first image carriers; a second image carrier, which moves at a predetermined speed and on which the toner images formed on the first image carriers by the image forming unit are transferred; a second image forming unit that transfers the toner images transferred on the second image carrier onto a transfer medium that is moved at the predetermined speed; a test pattern generating unit that generates a test pattern group with a predetermine length in a moving direction of the second image carrier; and an adjusting unit that determines a method to adjust an image formation condition for the first image forming unit using the test pattern group, based on a relationship between the predetermined length and a length of an image area, in which a print image based on the image data is formed, in a sub-scanning direction corresponding to the moving direction of the second image carrier.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
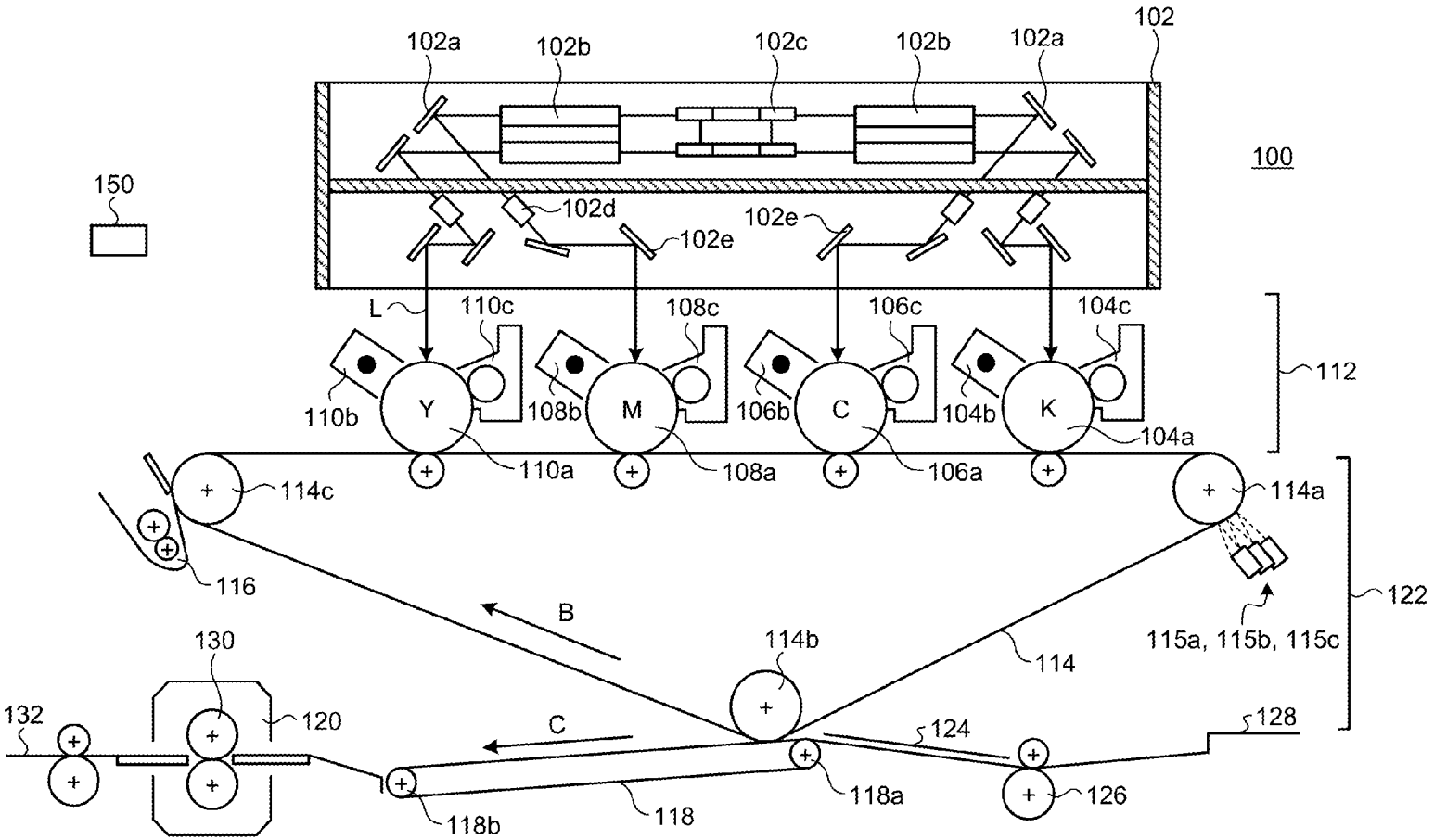
FIG. 1 is a diagram illustrating a configuration example of an image forming apparatus applicable to an embodiment of the present invention.

Exemplary embodiments of the present invention will be explained in detail below with reference to the accompanying drawings. FIG. 1 illustrates a configuration example of an image forming apparatus 100 applicable to an embodiment of the present invention.

Configuration Applicable to the Embodiment

The image forming apparatus 100 includes an optical device 102 including optical elements, such as a semiconductor laser and a polygon mirror; an image forming unit 112 including photosensitive drums, charging units, developing units, and the like; and a transfer unit 122 including an intermediate transfer belt and the like. The optical device 102, the image forming unit 112, and the transfer unit 122 implement functions of image forming means. A temperature sensor 150 is disposed inside a casing of the image forming apparatus 100.

The optical device 102 deflects light beams emitted by a laser light source, such as a semiconductor laser (not illustrated), by using a polygon mirror 102*c* to cause the light beams to enter fθ lenses 102*b*. In the example illustrated in FIG. 1, the same number of light beams as the number of colors of yellow (Y), magenta (M), cyan (C), and black (K) are emitted. The light beams of the respective colors pass through the fθ lenses 102*b*, are reflected by reflecting mirrors 102*a*, and are incident on WTL lenses 102*d*.

The WTL lenses 102*d* shape the light beams and deflect the light beams toward reflecting mirrors 102*e* so that the light beams based on images are applied as light beams L used for exposure to photosensitive drums 104*a*, 106*a*, 108*a*, and 110*a*. The light beams L are applied to the photosensitive drums 104*a*, 106*a*, 108*a*, and 110*a* via a plurality of the optical elements as described above. Therefore, a timing in the main-scanning direction that is a scanning direction of the light beams L and a timing in the sub-scanning direction orthogonal to the main-scanning direction are synchronized. Incidentally, the sub-scanning direction is generally defined as a rotation direction of the photosensitive drums 104*a*, 106*a*, 108*a*, and 110*a*.

Each of the photosensitive drums 104*a*, 106*a*, 108*a*, and 110*a* is structured such that a photoconductive layer including at least a charge generation layer and a charge transport layer is formed on a conductive drum made of aluminum or the like. The photoconductive layer is arranged in accordance with each of the photosensitive drums 104*a*, 106*a*, 108*a*, and 110*a*, and each of charging units 104*b*, 106*b*, 108*b*, and 110*b* including a corotron, a scorotron, or a charging roller, applies surface charges to the photoconductive layer.

The photosensitive drums 104*a*, 106*a*, 108*a*, and 110*a* on which static charges are applied by the charging units 104*b*, 106*b*, 108*b*, and 110*b*, respectively, are exposed with the light beams L based on images, so that electrostatic latent images are formed. The electrostatic latent images formed on the photosensitive drums 104*a*, 106*a*, 108*a*, and 110*a* are respectively developed by developing units 104*c*, 106*c*, 108*c*, and 110*c* each including a developing sleeve, a developer supply roller, a regulation blade, and the like, so that developer images are formed.

The developers carried on the photosensitive drums 104*a*, 106*a*, 108*a*, and 110*a* are transferred onto an intermediate transfer belt 114 that is moved in a direction of an arrow B by conveying rollers 114*a*, 114*b*, and 114*c*. The intermediate transfer belt 114 is moved toward a secondary transfer unit while carrying the developers of the colors of C, M, Y, and K. The secondary transfer unit includes a secondary transfer belt 118 and conveying rollers 118*a* and 118*b*. The secondary transfer belt 118 is moved in a direction of an arrow C by the conveying rollers 118*a* and 118*b*. An image receiving medium 124, such as a high-quality sheet or a plastic sheet, is fed from an image receiving medium housing unit 128, such as a sheet cassette, to the secondary transfer unit by a conveying roller 126.

The secondary transfer unit applies a secondary transfer bias to transfer a multicolor developer image carried on the intermediate transfer belt 114 onto the image receiving medium 124 that is adsorbed and held on the secondary transfer belt 118. The image receiving medium 124 is fed to a fixing device 120 along with movement of the secondary transfer belt 118. The fixing device 120 includes a fixing member 130, such as a fixing roller, containing a silicone rubber or a fluoro-rubber, applies heat and pressure to the image receiving medium 124 carrying the multicolor developer image to form a printed matter 132, and outputs the printed matter 132 to the outside of the image forming apparatus 100. After the multicolor developer image is transferred, residual developer remaining on the intermediate transfer belt 114 is removed by a cleaning unit 116 including a cleaning blade, and the intermediate transfer belt 114 is made ready for a next image formation process.

The image forming apparatus 100 according to the embodiment forms a color misregistration correction test pattern on the intermediate transfer belt 114 to adjust the quality of an image to be formed. On the downstream side of the photosensitive drums 104*a*, 106*a*, 108*a*, and 110*a* in the moving direction of the intermediate transfer belt 114, sensors 115*a*, 115*b*, and 115*c* are disposed to detect the color misregistration correction test pattern formed on the intermediate transfer belt 114. The sensors 115*a*, 115*b*, and 115*c* are arranged as close as possible to the photosensitive drum 104*a* on the most downstream side in the moving direction of the intermediate transfer belt 114 so that the color misregistration correction test pattern can be detected at an earlier timing.

Figure 2:
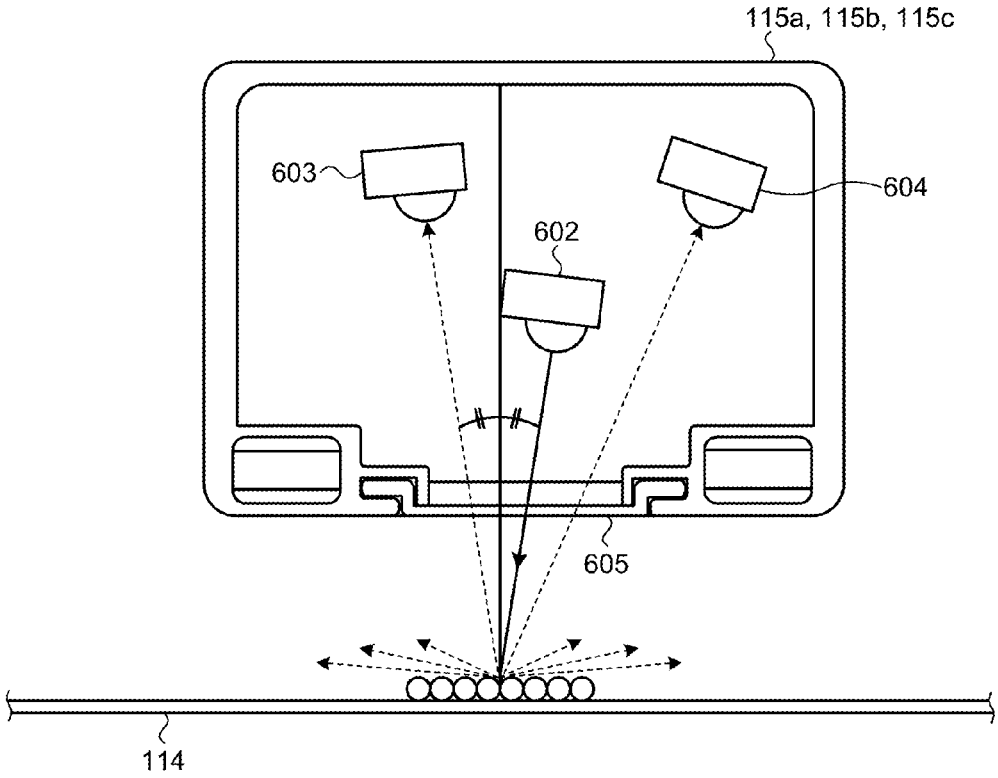
FIG. 2 is a diagram illustrating a configuration example of a sensor applicable to the embodiment.

FIG. 2 illustrates a configuration example of the sensors 115*a*, 115*b*, and 115*c* applicable to the embodiment. The same configuration can be applied to the sensors 115*a*, 115*b*, and 115*c*; therefore, in the following, the sensors 115*a*, 115*b*, and 115*c* are referred to as a sensor 115 as long as they need not be distinguished.

In FIG. 2, the sensor 115 includes one light-emitting element 602 and two light-receiving elements 603 and 604. The light-emitting element 602 is, for example, an infrared light emitting diode (LED), and irradiates the intermediate transfer belt 114 with the emitted infrared light. A laser light-emitting element may be used as the light-emitting element 602. Each of the light-receiving elements 603 and 604 is, for example, a phototransistor. A photodiode may be employed as each of the light-receiving elements 603 and 604 to amplify the output.

In this example, the light-receiving element 603 is arranged at a position so as to receive specular reflected light, which is infrared light emitted from the light-emitting element 602 and specularly reflected from the intermediate transfer belt 114, and the light-receiving element 604 is arranged at a position so as not to receive the specular reflected light. Specifically, the light-receiving element 604 receives diffuse reflected light, which is infrared light emitted by the light-emitting element 602 and diffusely reflected from the intermediate transfer belt 114. A focusing lens 605 is disposed on the optical path of the infrared light emitted from the light-emitting element 602 and on the optical paths of the specular reflected light and the diffuse reflected light that are infrared light reflected from the intermediate transfer belt 114.

In FIG. 2, the light-receiving element 603 for receiving the specular reflected light and the light-receiving element 604 for receiving the diffuse reflected light are provided. However, the present invention is not limited to this example. It may be possible to provide only one of the light-receiving elements depending on a detecting object or necessary information.

Figure 3:
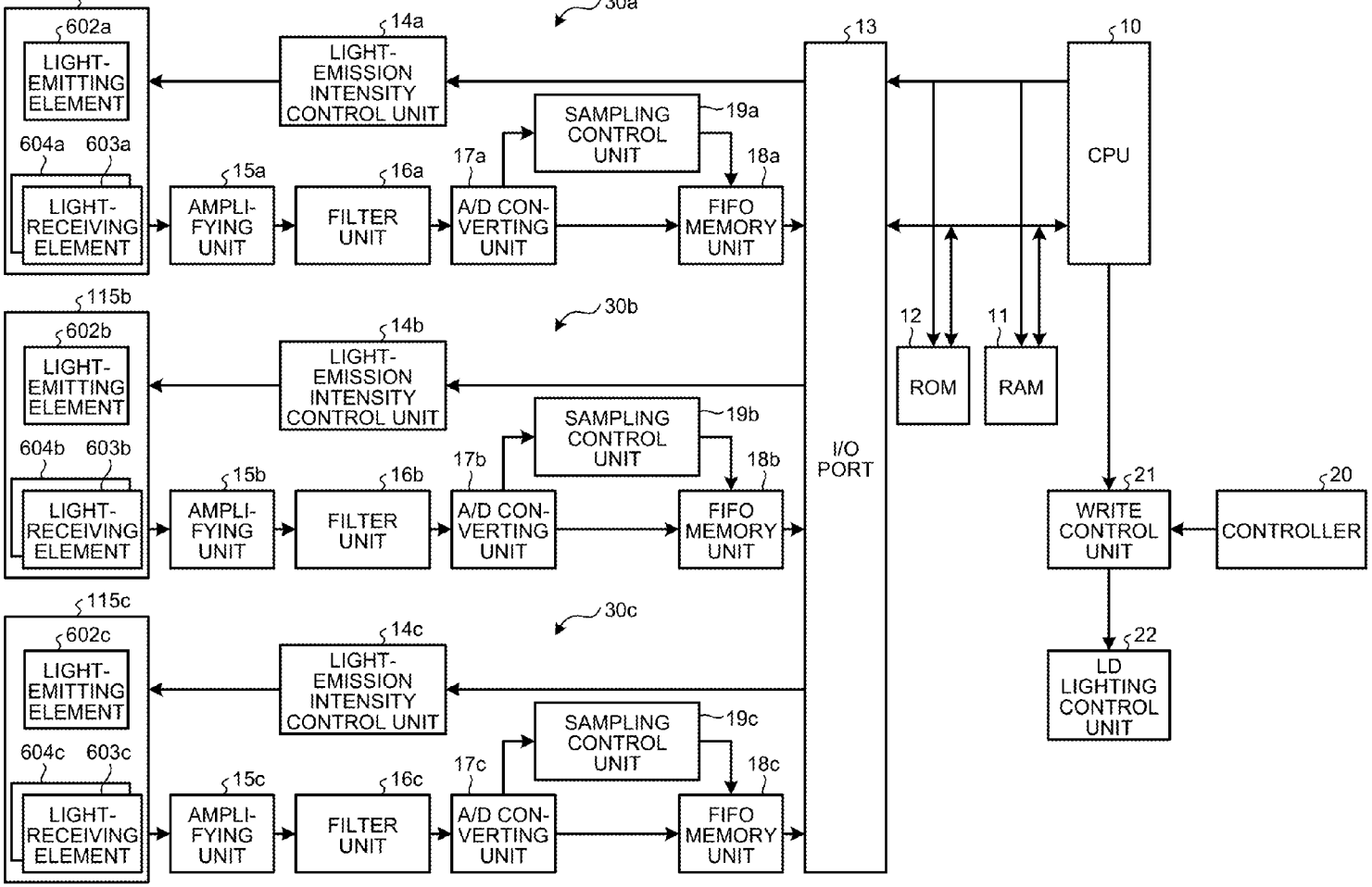
FIG. 3 is a block diagram illustrating a configuration example of a signal processing system applicable to the embodiment.

FIG. 3 illustrates a configuration example of a signal processing system in the image forming apparatus 100 applicable to the embodiment. In the following, components for detecting the amount of color misregistration which are deeply related to the embodiment among all of the components of the image forming apparatus 100 are mainly described.

A central processing unit (CPU) 10 performs predetermined arithmetic processing and controls a pattern detection of the embodiment, according to a program stored in a read only memory (ROM) 12 in advance, by using a random access memory (RAM) 11 as a working memory. The CPU 10 is connected to an input/output (I/O) port 13 via a data bus. The I/O port 13 controls read of data from first-in first-out (FIFO) memory units 18*a*, 18*b*, and 18*c* (to be described later) or data transfer via the data bus. A detection result of a temperature inside the casing detected by the temperature sensor 150 is supplied to the CPU 10.

The program stored in the ROM 12 includes modules for executing various processes including a test pattern row correction process. Examples of the modules include a module for executing a correction process for correcting an image formation condition for forming a color mage on the intermediate transfer belt 114, and a module for a calculation process for calculating the amount of positional misregistration in the main-scanning direction when a test pattern row is formed on the intermediate transfer belt 114.

The ROM 12 also pre-stores therein setting values for setting various operation conditions for each of the units of the image forming apparatus 100, a correction value of each of the setting values based on the internal temperature of the image forming apparatus 100, and the like. For example, various setting values of an electrical current for driving the laser light source, a rotation speed of the polygon mirror 102*c*, a rotation speed of each of the photosensitive drums 104*a*, 106*a*, 108*a*, and 110*a*, or a driving speed of the intermediate transfer belt 114, and a correction value of each of the setting values based on the internal temperature of the image forming apparatus 100 are stored in the ROM 12 in advance.

Signal processing units 30*a*, 30*b*, and 30*c* perform signal processing on the sensors 115*a*, 115*b*, and 115*c*, respectively. Specifically, the signal processing unit 30*a* includes a light-emission intensity control unit 14*a*, an amplifying unit 15*a*, a filter unit 16*a*, an analog-to-digital (A/D) converting unit 17*a*, the FIFO memory unit 18*a*, and a sampling control unit 19*a*. An output from the light-emission intensity control unit 14*a* is supplied to a light-emitting element 602*a* of the sensor 115*a*, and outputs from light-receiving elements 603*a* and 604*a* of the sensor 115*a* are supplied to the amplifying unit 15*a*.

Similarly, the signal processing unit 30*b* includes a light-emission intensity control unit 14*b*, an amplifying unit 15*b*, a filter unit 16*b*, an A/D converting unit 17*b*, the FIFO memory unit 18*b*, and a sampling control unit 19*b*. An output from the light-emission intensity control unit 14*b* is supplied to a light-emitting element 602*b* of the sensor 115*b*, and outputs from light-receiving elements 603*b* and 604*b* the sensor 115*b* are supplied to the amplifying unit 15*b*. Furthermore, the signal processing unit 30*c* includes a light-emission intensity control unit 14*c*, an amplifying unit 15*c*, a filter unit 16*c*, an A/D converting unit 17*c*, the FIFO memory unit 18*c*, and a sampling control unit 19*c*. An output from the light-emission intensity control unit 14*c* is supplied to a light-emitting element 602*c* of the sensor 115*c*, and outputs from light-receiving elements 603*c* and 604*c* of the sensor 115*c* are supplied to the amplifying unit 15*c*.

As described above, the signal processing units 30*a*, 30*b*, and 30*c* have the same configuration. Therefore, in the following, the signal processing unit 30*a* will be explained as a representative example of the signal processing units 30*a*, 30*b*, and 30*c*.

In the sensor 115*a*, a light-receiving element 603*a* that receives specular reflected light among the two light-receiving elements 603*a* and 604*a* is used to detect a test pattern formed on the intermediate transfer belt 114 (to be described later).

In the sensor 115*a*, when the light-receiving element 603*a* receives reflected light of the infrared light emitted by the light-emitting element 602*a*, the light-receiving element 603*a* outputs an analog detected signal corresponding to the intensity of the received infrared light. The analog detected signal is amplified by the amplifying unit 15*a*. A signal component for line detection is selectively passed through the filter unit 16*a* and supplied to the A/D converting unit 17*a* where the signal is converted to digital detected data. The sampling control unit 19*a* controls sampling of the detected data converted by the A/D converting unit 17*a*. The detected data sampled by the A/D converting unit 17*a* is stored in the FIFO memory unit 18*a*.

When detection of one test pattern is completed, the sampling control unit 19*a* causes the detected data of the test pattern stored in the FIFO memory unit 18*a* to be output from the FIFO memory unit 18*a*. The detected data output from the FIFO memory unit 18*a* is supplied to the CPU 10 and the RAM 11 via the I/O port 13. The CPU 10 calculates amounts of various types of misregistration, such as the amount of color misregistration, according to a program stored in the ROM 12.

The CPU 10 calculates a color misregistration correction value for correcting the amount of color misregistration calculated based on a detection result of the test pattern. The CPU 10 sets a change in the write start timing or the pixel clock frequency in the write control unit 21 in order to perform correction based on the calculated color misregistration correction value.

The write control unit 21 has a mechanism, such as a clock generator using a voltage controlled oscillator (VCO), capable of setting the output frequency in detail, and uses the output as a pixel clock. The write control unit 21 controls an LD lighting control unit 22 according to the image data transferred by a controller 20 with reference to the pixel clock, and the LD lighting control unit 22 controls lighting of a laser light source (not illustrated) under the control of the write control unit, so that images are written on the photosensitive drums 104*a*, 106*a*, 108*a*, and 110*a*. The controller 20 includes a CPU and controls the entire operation of the image forming apparatus 100.

A write control unit 21 writes the images on the photosensitive drums 104*a*, 106*a*, 108*a*, and 110*a* at a write timing or a pixel clock frequency that is set by the CPU 10 based on the color misregistration correction value, so that the images corrected based on the color misregistration correction value can be formed.

Meanwhile, the CPU 10 monitors the analog detected signal from the light-receiving element 603*a* at an appropriate timing, generates a control signal for controlling the level of the infrared light emitted by the light-emitting element 602*a* based on the monitoring result, and supplies the control signal to the light-emission intensity control unit 14*a* via the I/O port 13. The light-emission intensity control unit 14*a* controls the amount of light emitted by the light-emitting element 602*a* according to the control signal. Therefore, the level of the infrared light emitted by the light-emitting element 602*a* can be set to an approximately constant level, so that it becomes possible to reliably detect the test pattern even when the intermediate transfer belt 114 or the laser light source (not illustrated) is deteriorated.

Figure 4:
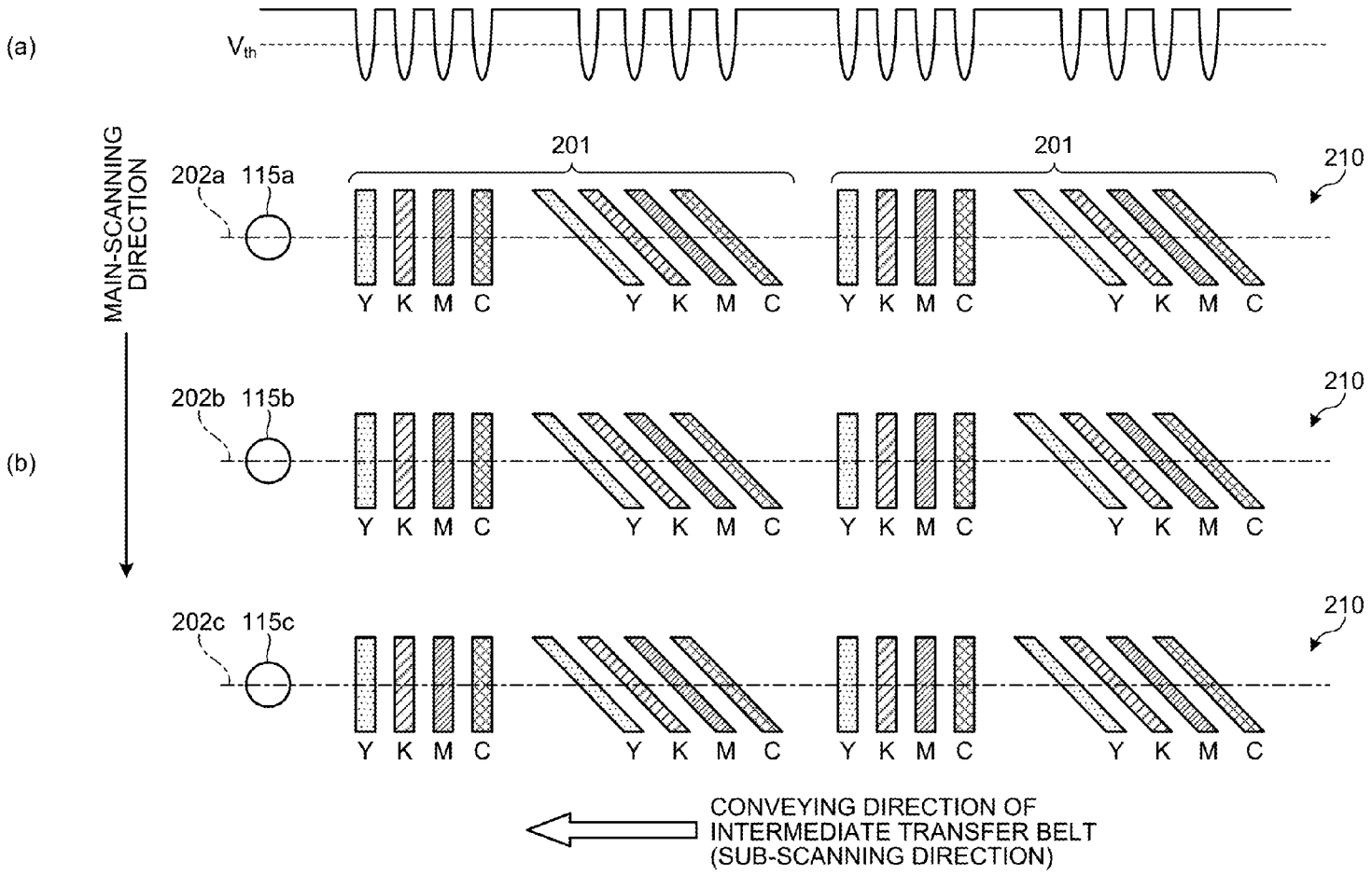
FIG. 4 is a diagram illustrating examples of test pattern rows according to the embodiment and an output signal output by the sensor when the sensor detects the test pattern rows.

FIG. 4 illustrates test pattern rows and an output signal of the sensor when the sensor detects the test pattern rows. As illustrated in section (b) in FIG. 4, three test pattern rows 210 are arranged such that a plurality of test pattern images 201, 201, . . . are arranged in accordance with the positions of sensors 115*a*, 115*b*, and 115*c* along the sub-scanning direction. In this case, eight test pattern images 201 are arranged as one set along the sub-scanning direction. Each of the test pattern images 201 contains patterns (horizontal patterns) that are formed horizontally with respect to the main-scanning direction of the photosensitive drums 104*a*, 106*a*, 108*a*, and 110*a* in order of the colors Y, K, M, and C, and patterns (diagonal patterns) that are formed at an angle of 45° with respect to the main-scanning direction in order of the colors Y, K, M, and C. The order of the colors of the horizontal patterns and the diagonal patterns may be changed.

When the intermediate transfer belt 114 on which the test pattern rows 210 are formed as described above is conveyed in the sub-scanning direction, the sensors 115*a*, 115*b*, and 115*c* move on the test pattern rows 210 along trajectories 202*a*, 202*b*, and 202*c* illustrated in section (b) in FIG. 4.

Section (a) in FIG. 4 illustrates an example of an output signal of the sensor 115*a* when the sensor 115*a* moves along the trajectory 202*a* for example. The sensor 115*a* detects the intermediate transfer belt 114 at portions other than the horizontal patterns and the diagonal patterns. For example, if the intermediate transfer belt 114 is colored in white and a detection level of white is set as a reference level, the detection level at the horizontal patterns and the diagonal patterns colored in other colors is reduced to a low (Low) state. The determination of the low state is performed based on, for example, whether the detection level is equal to or smaller than a predetermined threshold voltage level $V_{th}$. The CPU 10 detects each of the patterns by detecting the low state of the output from the sensor 115*a*.

Figure 5:
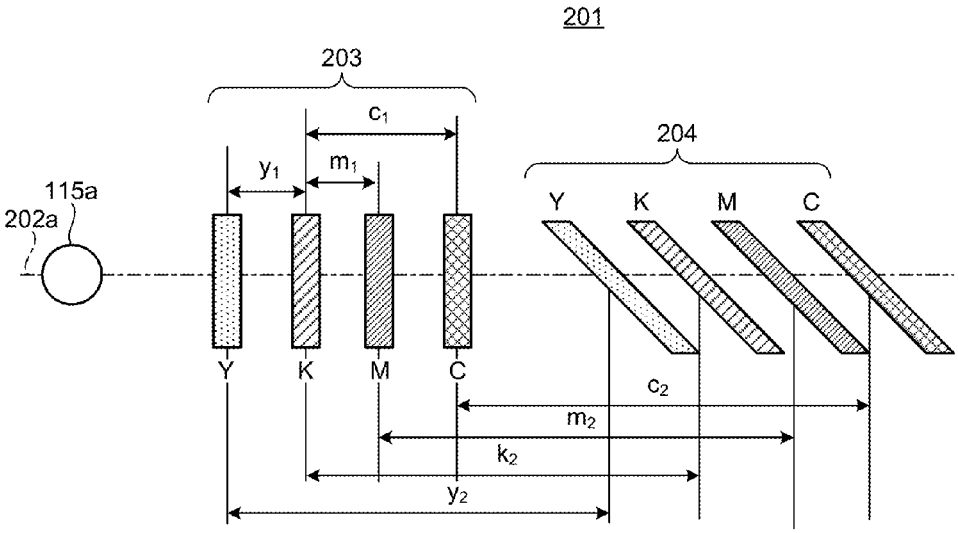
FIG. 5 is a diagram for explaining color misregistration detection by using test pattern images applicable to the embodiment.

The color misregistration detection by using the test pattern images 201 will be explained below with reference to FIG. 5. To calculate color misregistration in the sub-scanning direction, a horizontal pattern 203 is used and intervals ($y_1$, $m_1$, $c_1$) between the pattern of the color K serving as a reference color and the patterns of the other colors Y, M, and C are measured. Each of the measurement results is compared with an ideal distance between the corresponding color and the reference color to calculate the color misregistration in the sub-scanning direction.

To calculate the color misregistration in the main-scanning direction, intervals ($y_2$, $k_2$, $m_2$, $c_2$) between the lines of the horizontal pattern 203 and corresponding lines of a diagonal pattern 204 are measured. Each of the lines of the diagonal pattern 204 is inclined by an angle of 45° with respect to the main-scanning direction. Therefore, a difference in the measured interval between the reference color (the color K) and each of the other colors Y, M, and C serves as the amount of color misregistration of each of the colors Y, M, and C in the main-scanning direction. For example, the amount of color misregistration of the color Y in the main-scanning direction is obtained by $k_2-y_2$. As described above, it is possible to obtain the amounts of color misregistration (registration deviation) in the sub-scanning direction and in the main-scanning direction by using the test pattern images 201.

The detection of the amount of color misregistration as described above can be performed by using, for example, at least one of the test pattern images 201. If a plurality of the test pattern images 201 are used to detect the amount of color misregistration for each of the colors, it becomes possible to more accurately perform the color misregistration correction. For example, it may be possible to calculate the amount of color misregistration for each of the colors by performing a statistical processing, such as an averaging, on the amounts of color misregistration calculated by using the plurality of the test pattern images 201.

Furthermore, if the detection of the amount of color misregistration is performed by using the sensors 115*a*, 115*b*, and 115*c* disposed at different positions in the main-scanning direction, it becomes possible to detect components in the main-scanning direction and in the sub-scanning direction for each of the misregistration amount. For example, it is possible to obtain a skew component by calculating a difference between the amounts of color misregistration in the sub-scanning direction detected by the sensors 115*a* and 115*c*. Furthermore, if a pattern corresponding to the sensor 115*b* is additionally formed and differences in the amounts of color misregistration in the main-scanning direction between the sensors 115*a* and 115*b* and between the sensors 115*b* and 115*c* are calculated, it is possible to obtain a deviation in the magnification error.

As described above, by combining detection results of a plurality of the test pattern rows 210 output by the sensors 115*a*, 115*b*, and 115*c*, it is possible to adjust an image formation condition by correcting a plurality of items, such as misregistration in main-scanning direction, misregistration in the sub-scanning direction, skew correction, and a deviation in the magnification error in the main-scanning direction.

The test pattern used for adjusting the image quality at the time of printing includes various patterns other than the test pattern images 201 for the color misregistration correction. In this case, by forming only the test pattern images 201 for the color misregistration correction when the color misregistration correction is to be performed, it becomes possible to save toner consumed for forming test patterns for other image adjustment.

Next, a process for forming the test pattern rows 210 and transferring a printing image on the intermediate transfer belt 114 in a parallel way will be explained below with reference to FIG. 6. When formation of the test pattern rows 210 and transfer of a printing image 220 onto the intermediate transfer belt 114 are performed in a parallel way, the sensors 115*a* and 115*c* arranged at both ends in the main-scanning direction among the sensors 115*a*, 115*b*, and 115*c* are disposed at positions corresponding to the outer end portions of an image area of the printing image 220. As for the test pattern rows 210, the two test pattern rows 210 at both edges in the main-scanning direction are formed and the test pattern row 210 corresponding to the sensor 115*b* located in the center in the main-scanning direction is not formed among the test pattern rows 210.

Figure 6:
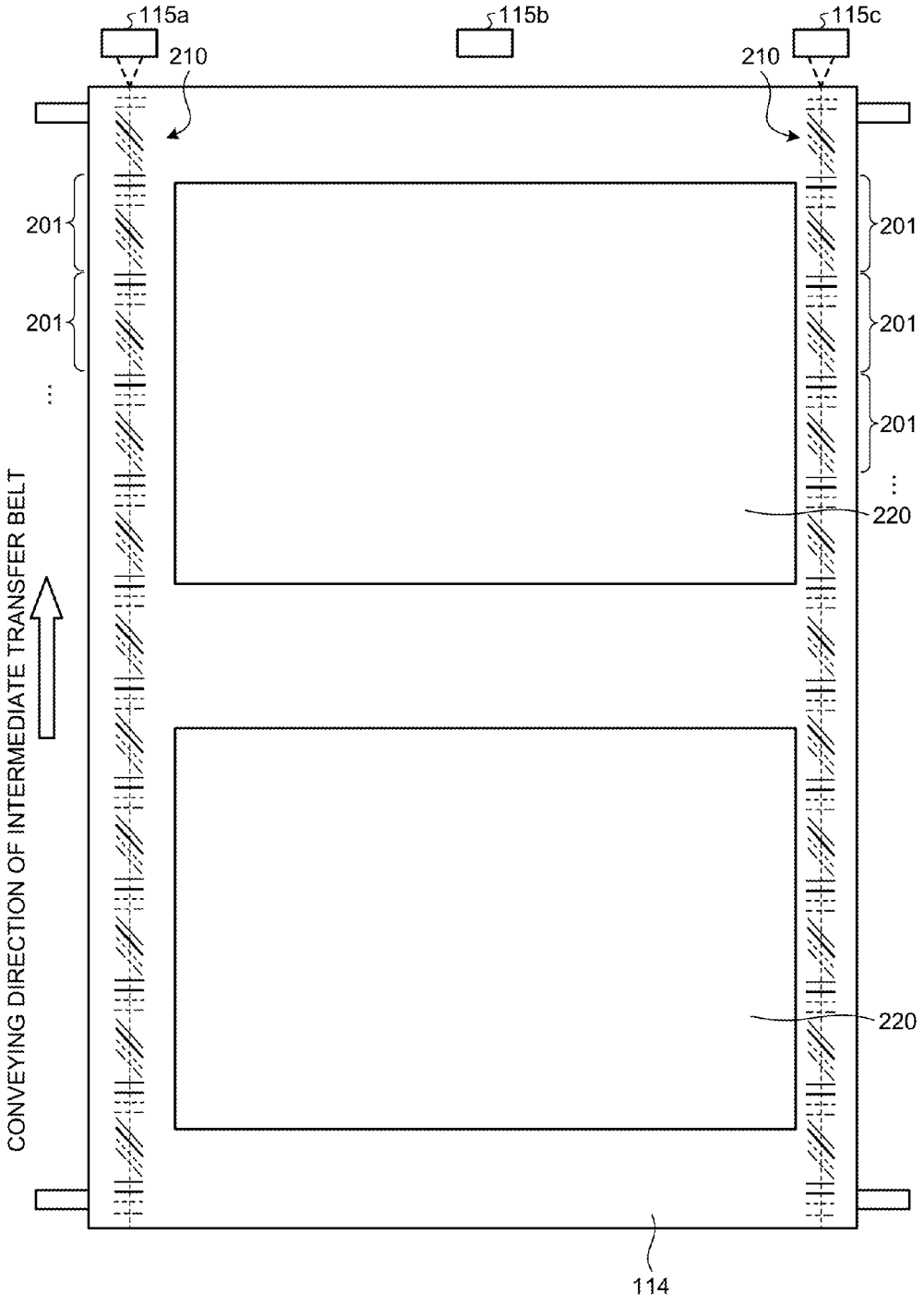
FIG. 6 is a diagram for explaining how a process for forming the test pattern rows according to the embodiment is performed in parallel with a process for transferring printing images on an intermediate transfer belt.

Furthermore, in the example in FIG. 6, the test pattern row 210 is formed such that multiple sets of the test pattern images 201 are sequentially arranged, where each set includes eight test pattern images 201.

As described above, by transferring the printing image 220 and forming the test pattern rows 210 onto the intermediate transfer belt 114 in a parallel way, and by adjusting the image quality of the printing image 220 based on the detection results of the test pattern rows 210, it becomes possible to reduce occurrence of a suspension period of printing operation due to the image quality adjustment, that is, to reduce so-called downtime. Consequently, it becomes possible to improve the productivity of the image forming apparatus 100.

Meanwhile, as illustrated in FIG. 6, in a system in which the output from the sensor 115*b* located in the center in the main-scanning direction is not used, it is possible to correct misregistration in the main-scanning direction, correct misregistration in the sub-scanning direction, and perform skew correction, but it is impossible to correct a deviation in the magnification error in the main-scanning direction.

Process According to the Embodiment

Adjustment of the image formation condition according to the embodiment will be explained below. As explained above with reference to FIG. 6, the image forming apparatus 100 according to the embodiment forms the test pattern rows 210 and transfer the printing image 220 onto the intermediate transfer belt 114 in a parallel way. In this case, for example, the image forming apparatus 100 adjusts the image formation condition by using the consecutive eight test pattern images 201 serving as one unit in the test pattern row 210. Specifically, the image forming apparatus 100 performs a statistical processing, such as an averaging, on the detection results of the eight consecutive test pattern images 201 to obtain the amount of color misregistration for each of the colors, and calculates the correction values of a plurality of items needed to adjust the image formation condition.

Hereinafter, the eight consecutive test pattern images 201 serving as one unit for adjusting the image formation condition are collectively referred to as a test pattern group.

When formation of the test pattern rows 210 and transfer of the printing image 220 onto the intermediate transfer belt 114 are performed in a parallel way, and if the image formation condition is adjusted in units of a test pattern group formed of a predetermined number of the test pattern images 201, a process to be performed differs depending on a relationship between the length of an image area in which the printing image 220 is to be formed in the sub-scanning direction and the length of the test pattern group. Specifically, in the embodiment, the direction of adjusting the image formation condition is determined depending on the relationship between the length of the image area in the sub-scanning direction and the length of the test pattern group.

Meanwhile, it is assumed that the image formation condition for a certain page in the image area are set by using completion of the image area of a previous page preceding the certain page as a trigger. The setting of the image formation condition at this time include setting of formation conditions for forming the test pattern images 201. The image area may be formed such that the length of the image area in the sub-scanning direction is equal to the length of the printing image 220 in the sub-scanning direction and the printing image 220 is formed in the image area, or may be formed so as to correspond to the length of a transfer medium (printing sheet) in the sub-scanning direction on which the printing image 220 is to be transferred. The image area is indicated by, for example, the image area signal generated by the controller 20.

Specifically, if the image area is formed as an area in which the printing image 220 is to be formed, the formation completion timing of the printing image 220 is a timing at which the image area signal is negated. For example, if the image area signal is in the low (L: Low) state indicating a period during which the printing image 220 of one page is transferred, a timing at which the image area signal in the L state is negated and enters the high (H: High) state indicates a timing at which the formation of the printing image 220 of one page is completed. Therefore, by sampling the image area signal of each of the colors, it is possible to recognize a timing at which the printing image 220 of each of the colors is completed. Therefore, it becomes possible to set an image condition for a next page at an appropriate timing.

However, if a magnitude relation between the length of the image area in the sub-scanning direction and the length of the test pattern group is not clear, it may be possible that formation of the test pattern group is not completed at a time $t_{K2}$ corresponding to the trailing end of the image area.

Figure 7:
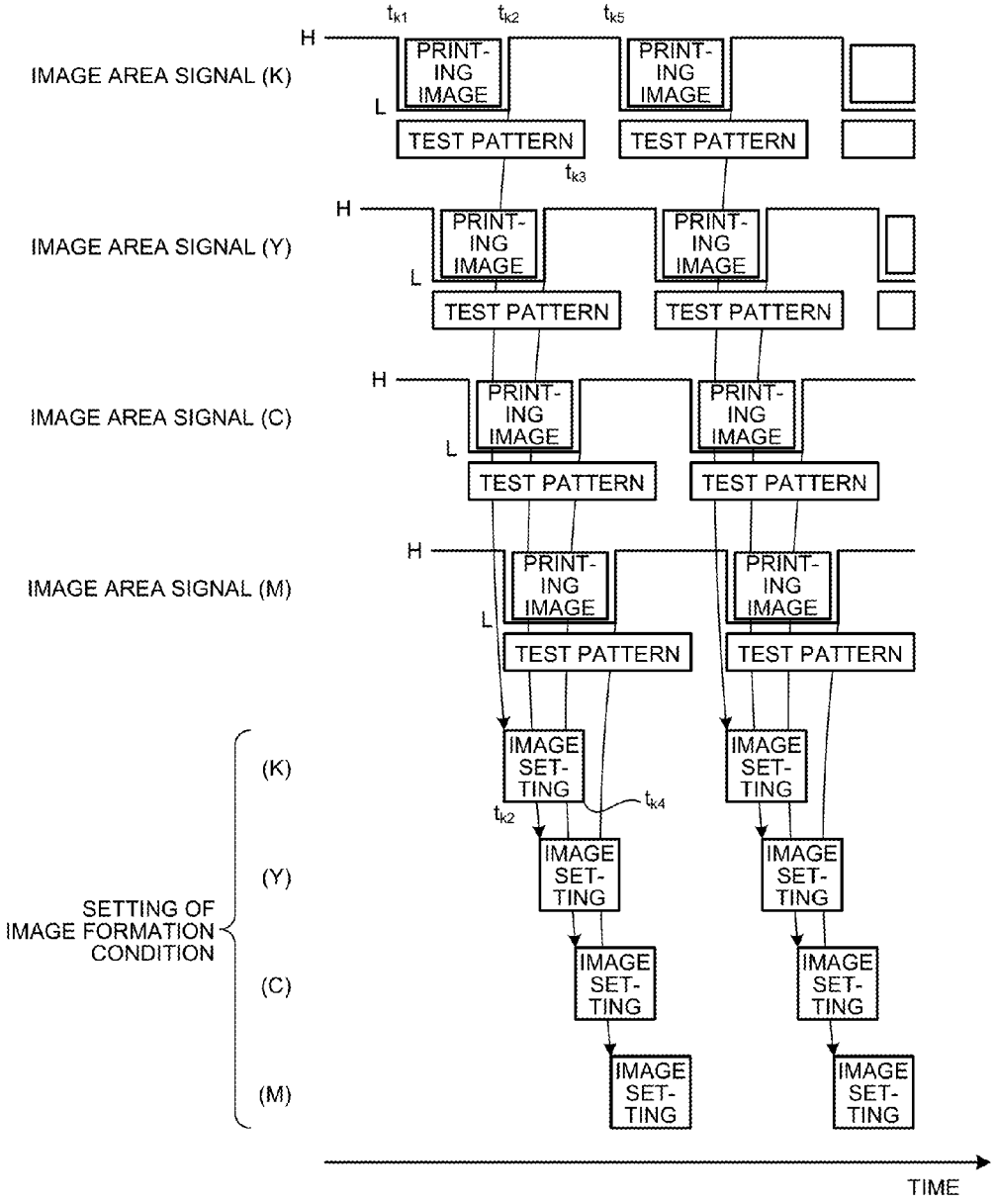
FIG. 7 is a diagram for explaining an example in which the length of a printing image is shorter than the length of a test pattern group.

With reference to FIG. 7, an example will be explained in which the length of the image area is shorter than the length of the test pattern group. In the example in FIG. 7, as for the color K for example, an image area signal (K) enters the L state at a time $t_{K1}$, and formation of the printing image 220 is started. Thereafter, the image area signal (K) is negated and enters the H state at the time $t_{K2}$, indicating that the formation of the printing image 220 of one page is completed. After a lapse of a predetermined time designated as an interval between image areas, the image area signal (K) is asserted at a time $t_{K5}$, so that formation of the printing image 220 of a next page is started. The predetermined time is set to a longer time than a time needed to set the image condition.

In the example in FIG. 7, the length of the test pattern group is longer than the length of the image area in the sub-scanning direction. Therefore, the image area signal (K) is asserted at the time $t_{K1}$ so that formation of the printing image 220 and formation of the test pattern group are started simultaneously. At a time $t_{K3}$ later than the time $t_{K2}$ at which the image area signal (K) is negated and formation of the printing image 220 is completed, formation of the test pattern group is completed.

As described above, the setting of the image formation condition is started at the time $t_{K2}$ at which the image area signal (K) is negated, and finished at the time $t_{K4}$ after a lapse of a predetermined time. At the time $t_{K2}$ at which the setting of the image formation condition is started, formation of the test pattern group is not yet completed. Therefore, the image formation condition for the test pattern group may be changed to the image formation condition for a next page even when the test pattern group is being formed.

If the setting of the image formation condition for the test pattern group is not performed appropriately, the shape of the test pattern group may be changed in the middle of the test pattern group, and it may become difficult to accurately perform various types of color misregistration detection. Consequently, the image quality of the printing image 220 to be formed may be reduced.

Figure 8:
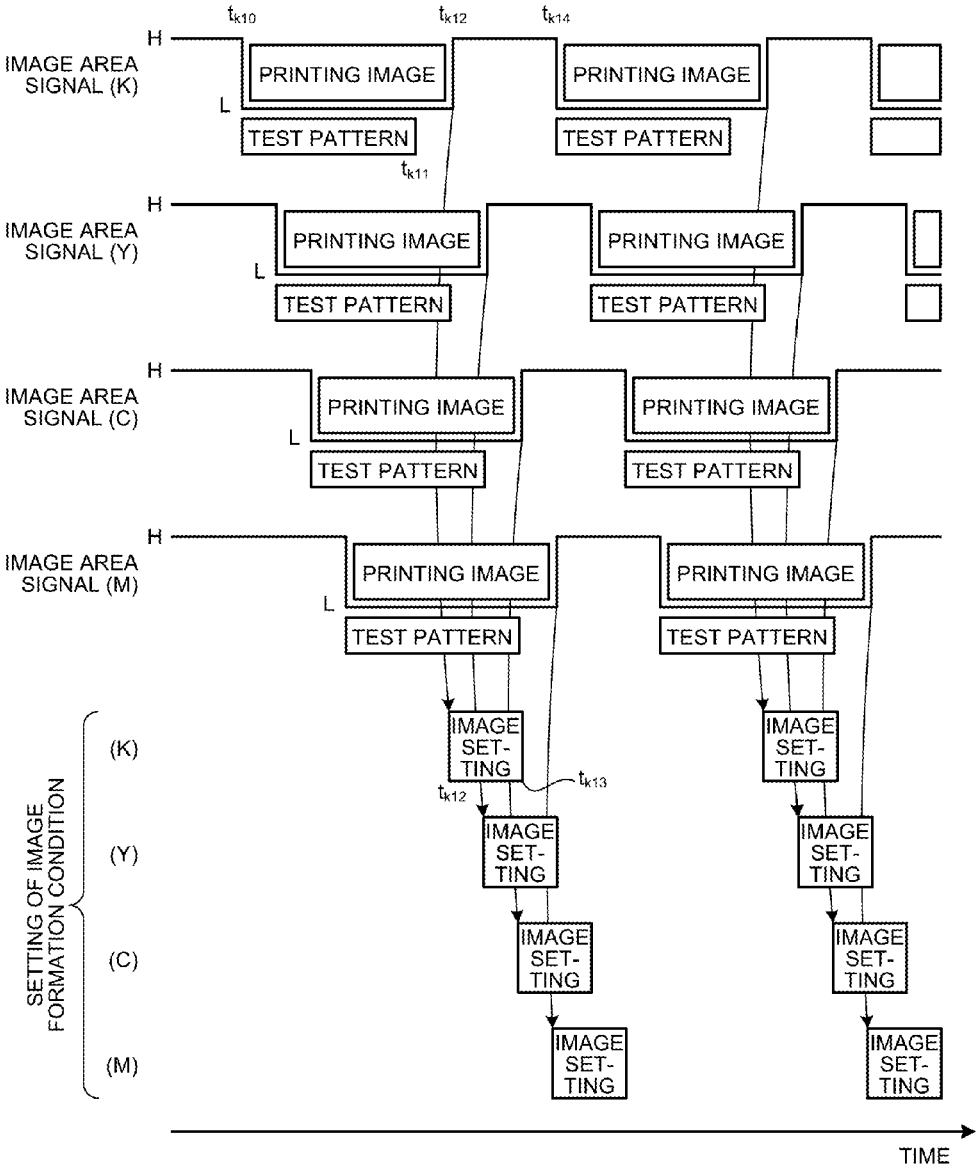
FIG. 8 is a diagram for explaining an example in which the length of a printing image is equal to or longer than the length of a test pattern group.

With reference to FIG. 8, an example will be explained in which the length of the image area is equal to or longer than the length of the test pattern group. In this case, the image area signal (K) is asserted at a time $t_{K10}$, and formation of the test pattern group that is started at the same time as the start of formation of the printing image 220 is surely completed before a time $tK_{12}$, at which the image area signal (K) is negated and formation of the printing image 220 is completed (see a time $t_{K11}$).

Therefore, the setting of the image formation condition that occurs based on the detection result of the test pattern group by using negation of the image area signal (K) as a trigger is started after completion of all of the test pattern group is detected. Therefore, it is possible to prevent a situation as explained above with reference to FIG. 7, in which the image formation condition for the test pattern group is changed to an image formation condition of a next page even when the test pattern group is being formed.

The setting of the image formation condition started at the time $t_{K12}$ is finished at a time $t_{K13}$. When a predetermined time designated as an interval between the printing images 220 has elapsed since the time $t_{K12}$, and if a time $t_{K14}$ comes after the time $t_{K13}$ at which the setting of the image formation condition is completed, formation of the printing image 220 of a next page and formation of the test pattern group are started according to the image formation condition set in the period from the time $t_{K12}$ to the time $t_{K13}$.

Figure 9:
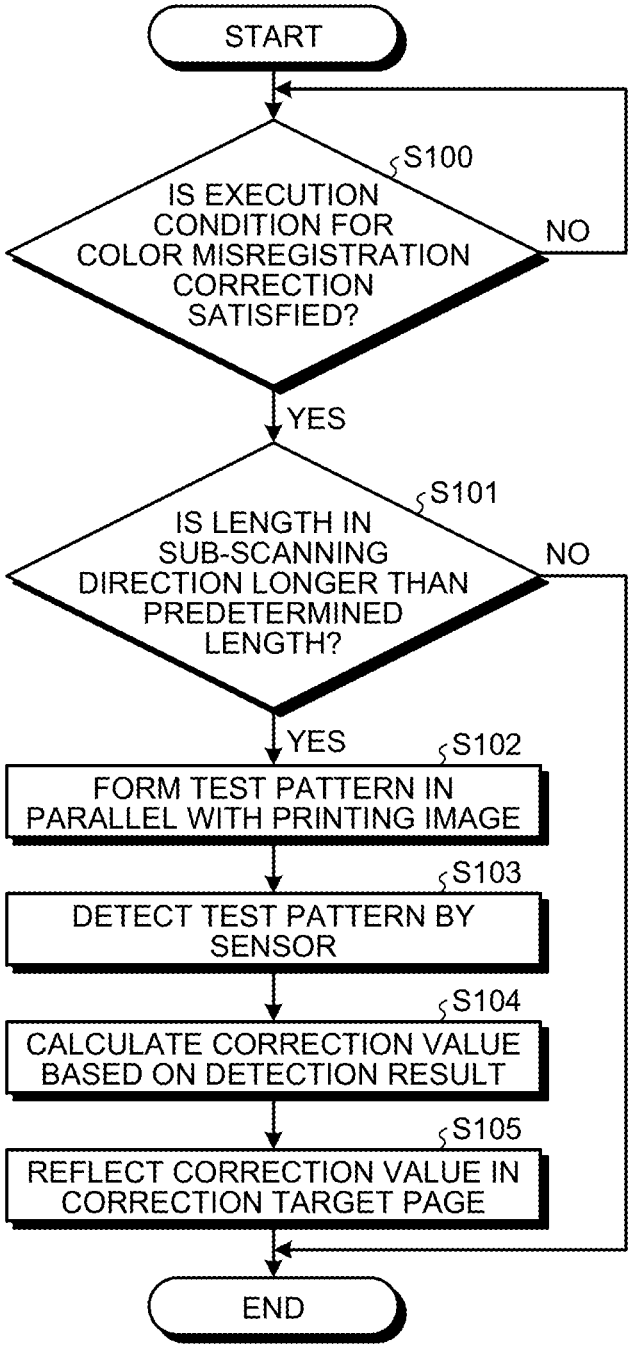
FIG. 9 is a flowchart illustrating an example of a process for adjusting an image formation condition according to the embodiment.

FIG. 9 is a flowchart illustrating an example of a process for adjusting the image formation condition according to the embodiment. Each process in the flowchart in FIG. 9 is executed by causing the CPU 10 to read a program from the ROM 12 and control each of the units of the image forming apparatus 100. In the following, it is assumed that an image area serves as an image formation area for the printing image 220, and an image area signal indicates a period corresponding to the area in the sub-scanning direction.

Before execution of the process in the flowchart in FIG. 9, the CPU 10 monitors the status of each of the units of the image forming apparatus 100. At Step S100, the CPU 10 determines whether the status of the image forming apparatus 100 satisfies an execution condition for executing the color misregistration correction, based on the monitoring result. Examples of the execution condition include a temperature of the image forming apparatus 100 and the total number of printed sheets. When determining that the status of the image forming apparatus 100 does not satisfy the execution condition, the CPU 10 repeats the process at Step S100.

When determining that the status of the image forming apparatus 100 satisfies the execution condition for executing the color misregistration correction, the CPU 10 causes the process to proceed to Step S101. At Step S101, the CPU 10 determines whether the image area (for example, the printing image 220) designated by a current print job is longer than a predetermined length in the sub-scanning direction. The predetermined length is, for example, the length of the test pattern group.

When determining that the length in the sub-scanning direction is equal to or shorter than the predetermined length, the CPU 10 does not form the test pattern group on the intermediate transfer belt 114 and does not perform the color misregistration correction process. Therefore, it is possible to prevent a situation as illustrated in FIG. 7, in which the image formation condition for the test pattern group is changed to an image formation condition of a next page even when the test pattern group is being formed.

At Step S101, when determining that the length of the printing image 220 in the sub-scanning direction is longer than the predetermined length, the CPU 10 causes the process to proceed to Step S102, and starts formation of the test pattern groups corresponding to the sensors 115*a* and 115*c* on the intermediate transfer belt 114 in parallel with formation of the printing image 220.

The CPU 10 detects the test pattern groups based on the outputs from the sensors 115*a* and 115*c* (Step S103). At Step S104, as explained above with reference to FIG. 5, the amounts of color misregistration in the main-scanning direction and in the sub-scanning direction are obtained based on information on the detected test pattern groups, and various correction values are calculated based on the obtained amounts of color misregistration. After calculating the correction values, at Step S105, the CPU 10 reflects the correction values calculated at Step S104 in the formation of the printing image 220 of a correction target page.

As described above, according to the embodiment, when it is determined that the length of the image area in the sub-scanning direction is equal to or shorter than a predetermined length, the test pattern group is not formed on the intermediate transfer belt 114 and the color misregistration correction process is not performed. Therefore, it is possible to prevent a situation in which the image formation condition is changed to an image formation condition for a next page while the test pattern group is being formed. In this regard, however, because the color misregistration correction process is not performed when the length of the image area in the sub-scanning direction is equal to or shorter than the predetermined length, the image quality may be reduced.

In the embodiment, the image area is set as an image area in which the printing image 220 is formed. However, the present invention is not limited to this example. For example, the image area may be set as an area of a transfer medium on which the printing image 220 is transferred.

In this case, when the length of the transfer medium in the sub-scanning direction is longer than the length of the test pattern group, the process proceeds to Step S102. Furthermore, when the length of the transfer medium in the sub-scanning direction is equal to or shorter than the length of the test pattern group, the test pattern group is not formed and the color misregistration correction process is not performed. In this case, the test pattern group is formed on the outside of the transfer medium in the sub-scanning direction.

Modification of the Embodiment

Figure 10:
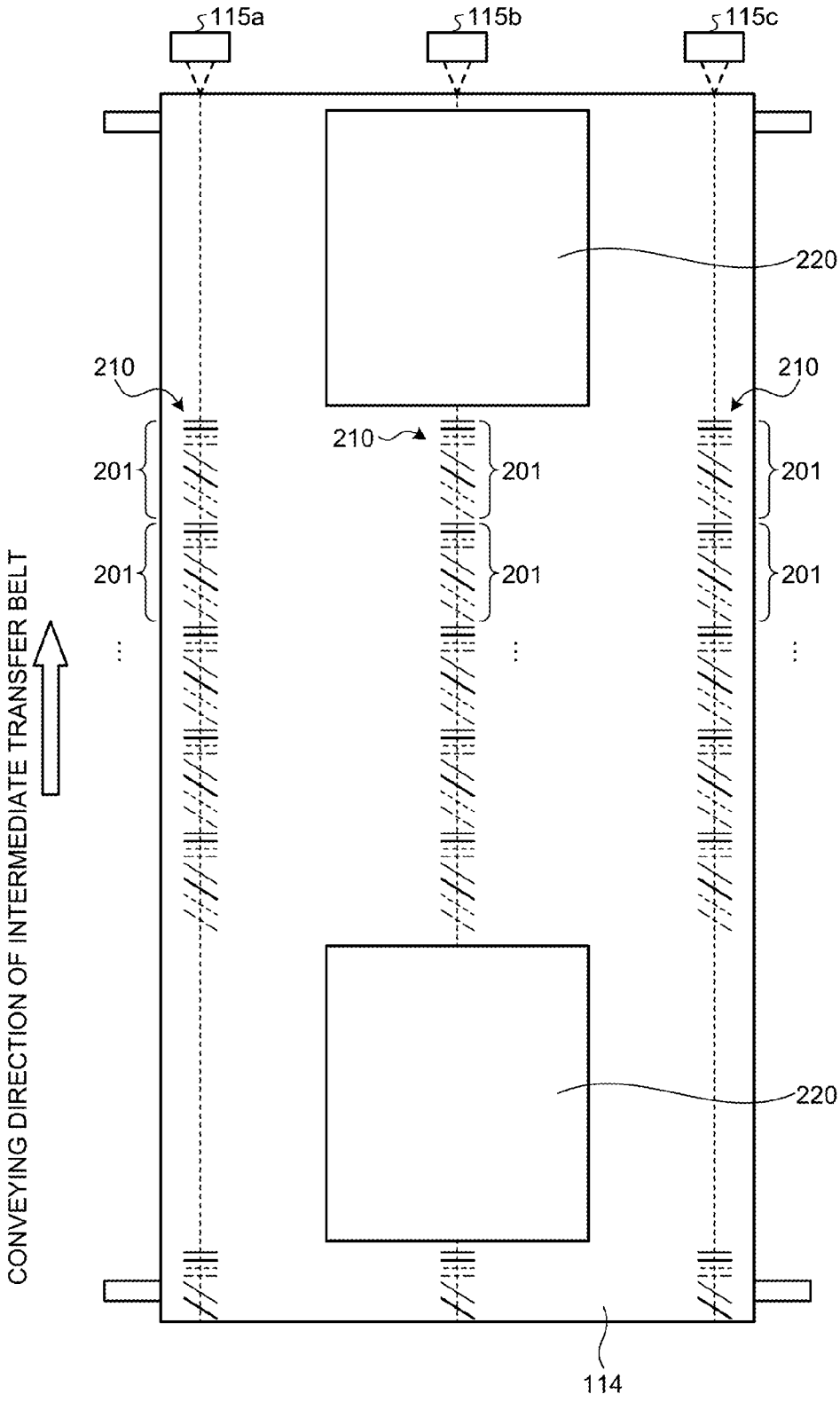
FIG. 10 is a diagram for explaining a method for forming a test pattern group according to a modification of the embodiment.

A modification of the embodiment will be explained below. In the modification of the embodiment, as illustrated in FIG. 10 for example, when the length of the image area in the sub-scanning direction is equal to or shorter than a predetermined length, a sheet interval is increased and the test pattern groups corresponding to the sensors 115*a*, 115*b*, and 115*c* are formed in an area of the increased sheet interval on the intermediate transfer belt 114. The sheet interval is an interval in the sub-scanning direction between a transfer medium on which the printing image 220 of a certain page is transferred and a transfer medium on which the printing image 220 of a next page is transferred. The CPU 10 performs the color misregistration correction process based on the detection results obtained by the sensors 115*a*, 115*b*, and 115*c* by detecting the test pattern groups formed in the area of the increased sheet interval on the intermediate transfer belt 114, and sets an image formation condition for a next page.

Figure 11:
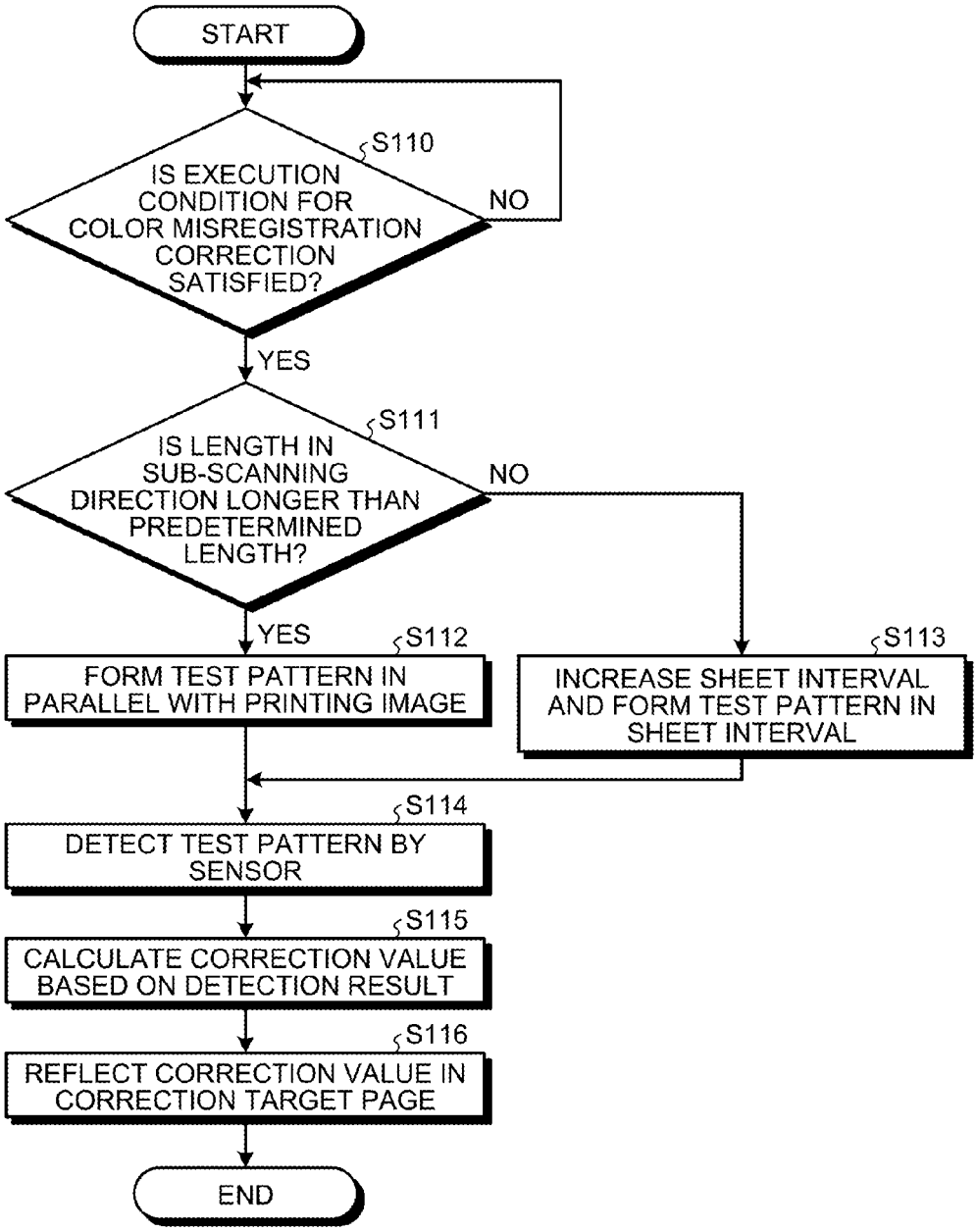
FIG. 11 is a flowchart illustrating an example of a process for adjusting an image formation condition according to the modification of the embodiment.

FIG. 11 illustrates an example of a process for adjusting the image formation condition according to the modification of the embodiment. Each process in the flowchart in FIG. 11 is executed by causing the CPU 10 to read a program from the ROM 12 and control each of the units of the image forming apparatus 100.

Before execution of the process in the flowchart in FIG. 11, the CPU 10 monitors the status of each of the units of the image forming apparatus 100, and determines whether the status of the image forming apparatus 100 satisfies an execution condition for executing the color misregistration correction based on the monitoring result (Step S110). When determining that the status of the image forming apparatus 100 does not satisfy the execution condition, the CPU 10 repeats the process at Step S110.

When determining that the status of the image forming apparatus 100 satisfies the execution condition for executing the color misregistration correction, the CPU 10 causes the process to proceed to Step S111. At Step S111, the CPU 10 determines whether the length of the image area (for example, the printing image 220) designated by a current print job is longer than a predetermined length (for example, the length of the test pattern group) in the sub-scanning direction.

When determining that the length of the image area in the sub-scanning direction is equal to or shorter than the predetermined length, the CPU 10 causes the process to proceed to Step S113. At Step S113, the CPU 10 increase the sheet interval to the predetermined length or longer. For example, the CPU 10 instructs the controller 20 to increase the sheet interval. When receiving the instruction, the controller 20 controls operation of the optical device 102, the image forming unit 112, and the transfer unit 122 of the image forming apparatus 100 so as to set the interval between transfer media on which the printing images 220 are transferred to a predetermined interval or longer.

For example, the sheet interval may be controlled based on the size of the transfer medium (printing sheet) in the sub-scanning direction on which the printing image 220 is transferred, based on the output of the detection sensor that detects a leading end position of the transfer medium and that is disposed at a predetermined position in the image forming apparatus 100, and based on the conveying speed of the transfer material.

At Step S113, the CPU 10 increases the sheet interval and forms the test pattern group in the area of the sheet interval on the intermediate transfer belt 114. For example, as explained above with reference to FIG. 10, the CPU 10 forms the test pattern groups at positions corresponding to the sensors 115*a*, 115*b*, and 115*c*. At this time, the CPU 10 controls the length of the sheet interval so that at least one test pattern group can be formed in the sub-scanning direction and a correction value calculation process for adjusting the image formation condition based on the detection result can be finished after detection of the test pattern group is completed. The length of the sheet interval as described above is stored in the ROM 12 in advance, as device specification information on the image forming apparatus 100 for example. After the test pattern groups are formed in the area of the sheet interval on the intermediate transfer belt 114, the process proceeds to Step S114.

At Step S111, when determining that the length of the image area in the sub-scanning direction is longer than the predetermined length, the CPU 10 causes the process to proceed to Step S112, and starts formation of the printing image 220 in the image area in parallel with formation of the test pattern groups corresponding to the sensors 115*a* and 115*c* on the intermediate transfer belt 114.

At Step S114, the CPU 10 detects the test pattern groups based on the outputs from the sensors 115*a* and 115*c* (when the process proceeds from Step S112 to Step S114) or based on the outputs from the sensors 115*a*, 115*b*, and 115*c* (when the process proceeds from Step S113 to Step S114). At Step S115, similarly to the case explained above with reference to FIG. 5, the amounts of color misregistration in the main-scanning direction and in the sub-scanning direction are obtained based on information on the detected test pattern groups, and various correction values area calculated based on the obtained amounts of color misregistration. After calculating the correction values, at Step S116, the CPU 10 reflects the correction values calculated at Step S115 in the formation of the printing image 220 of a correction target page.

As described above, according to the modification of the embodiment, when the length of the image area in the sub-scanning direction is shorter than a predetermined length, the test pattern group is not formed in parallel to the image area, but the sheet interval is increased and the test pattern group is formed in the area of the increased sheet interval. While the throughput is reduced due to an increase in the sheet interval, it is possible to perform the color misregistration correction process and prevent a decrease in the image quality.

In the modification of the embodiment, the image area is set as an image area in which the printing image 220 is formed. However, the present invention is not limited to this example. The image area may be set as an area of a transfer medium on which the printing image 220 is transferred.

According to an embodiment of the present invention, it is possible to set image settings at an appropriate timing when a test pattern is formed outside a printing area in parallel with printing of an image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a first image forming unit configured to form toner images based on image data on a plurality of first image carriers;

a second image carrier configured to move at a desired speed and on which the toner images formed on the first image carriers by the image forming unit are transferred;

a second image forming unit configured to transfer the toner images transferred on the second image carrier onto a transfer medium that is moved at the desired speed;

a test pattern generating unit configured to generate a test pattern group with a desired length in a moving direction of the second image carrier; and an adjusting unit configured to adjust an image formation condition for the first image forming unit using the test pattern group based on a relationship between the desired length and a length of an image area in which a print image based on the image data is formed in a sub-scanning direction corresponding to the moving direction of the second image carrier.

2. The image forming apparatus according to claim 1, wherein when the length of the image area in the sub-scanning direction is longer than the desired length, the adjusting unit is configured to:

form the test pattern group on an outside of the image area on the second image carrier along the moving direction, detect the test pattern group thus formed, and adjust the image formation condition for the first image forming unit based on a detection result.

3. The image forming apparatus according to claim 1, wherein when the length of the image area in the sub-scanning direction is equal to or shorter than the desired length, the adjusting unit is configured to:

control movement of the transfer medium so as to increase an interval between transfer media to a desired length or longer in the moving direction, form the test pattern group between an interval from a trailing end of a transfer medium and a leading end of a next transfer medium in the moving direction, detect the test pattern group thus formed, and adjust the image formation condition for the first image forming unit based on a detection result.

4. The image forming apparatus according to claim 1, wherein when the length of the image area in the sub-scanning direction is equal to or shorter than the desired length, the adjusting unit does is configured to not adjust the image formation condition based on the test pattern group.

5. The image forming apparatus according to claim 1, wherein the image area is an area of a printing image to be formed based on the image data.

6. The image forming apparatus according to claim 1, wherein the image area is an area of the transfer medium on which the printing image is to be transferred.

7. A method of controlling an image forming apparatus, the method comprising:

forming toner images based on image data on a plurality of first image carriers;

transferring the toner images on a second image carrier moving at a desired speed;

forming an image by transferring the toner images transferred on the second image carrier onto a transfer medium being moved at the desired speed;

generating a test pattern group with a desired length in a moving direction of the second image carrier; and adjusting an image formation condition for formation of the toner images using the test pattern group based on a relationship between the desired length and a length of an image area in which a printing image based on the image data is formed in a sub-scanning direction corresponding to the moving direction of the second image carrier.

8. The method of claim 7, wherein when the length of the image area in the sub-scanning direction is longer than the desired length, and the adjusting further comprises:

forming the test pattern group on an outside of the image area on the second image carrier along the moving direction, detecting the test pattern group thus formed, and adjusting the image formation condition for the first image forming unit based on a detection result.

9. The method of claim 7, wherein when the length of the image area in the sub-scanning direction is equal to or shorter than the desired length, and the adjusting further comprises:

controlling movement of the transfer medium so as to increase an interval between transfer media to a desired length or longer in the moving direction, forming the test pattern group between an interval from a trailing end of a transfer medium and a leading end of a next transfer medium in the moving direction, detecting the test pattern group thus formed, and adjusting the image formation condition for the first image forming unit based on a detection result.

10. The method of claim 7, wherein when the length of the image area in the sub-scanning direction is equal to or shorter than the desired length, the image formation condition is not adjusted based on the test pattern group.

11. The method of claim 7, wherein the image area is an area of a printing image to be formed based on the image data.

12. The method of claim 7, wherein the image area is an area of the transfer medium on which the printing image is to be transferred.

* * * * *